United States Patent [19]

Chavee et al.

[11] 4,394,836

[45] Jul. 26, 1983

[54] RIFLE-GRENADE WITH BULLET PASS-THROUGH DEVICE

[75] Inventors: René M. Chavée; André J. Gabriels, both of Genk, Belgium

[73] Assignee: Fabrique Nationale Herstal, en abrégé F.N., Société Anonyme, Herstal, Belgium

[21] Appl. No.: 208,691

[22] Filed: Nov. 20, 1980

[30] Foreign Application Priority Data

Nov. 30, 1979 [BE] Belgium ..... 58241

[51] Int. Cl.[3] ..... F42B 11/42

[52] U.S. Cl. ..... 102/485; 42/1 F

[58] Field of Search ..... 42/1 F; 102/484, 485

[56] References Cited

U.S. PATENT DOCUMENTS

| | | | |
|---|---|---|---|
| 3,318,033 | 5/1967 | Barr | 42/1 F |
| 3,395,478 | 8/1968 | Harvey | 42/1 F |
| 3,664,263 | 5/1972 | Driscoll | 102/485 |
| 3,726,036 | 4/1973 | Jennings et al. | 42/1 F |
| 4,013,011 | 3/1977 | Gabriels | 102/485 |
| 4,040,330 | 8/1977 | Matzen | 86/20 C |
| 4,253,889 | 3/1981 | Maes | 86/20 C X |

FOREIGN PATENT DOCUMENTS

| | | | |
|---|---|---|---|
| 30051 | 5/1980 | European Pat. Off. | 102/484 |
| 2461921 | 3/1981 | France | 102/485 |
| 2031562 | 3/1980 | United Kingdom | 102/485 |

*Primary Examiner*—Peter A. Nelson

*Attorney, Agent, or Firm*—Bacon & Thomas

[57] ABSTRACT

The invention pertains to a rifle-grenade, of the type comprising a head prolonged by a tubular shank, the aforesaid head being traversed by an axial bore running into the bore of the aforesaid tubular shank, characterized in that a plug is forced into one of the aforesaid bores, this plug being made from a material the hardness of which ranges from approximately 30 Shore A to approximately 70 Shore D.

4 Claims, 4 Drawing Figures

RIFLE-GRENADE WITH BULLET PASS-THROUGH DEVICE

The present invention relates to a rifle-grenade destined to be thrown by means of a rifle or similar, preferably by means of a conventional ball cartridge.

Projectiles, for instance grenades, have been proposed which can be thrown by means of a rifle. These projectiles generally comprise a head containing an explosive charge, this head being prolonged by a tubular shank destined to be slid on and around the barrel of a rifle, mostly equipped for this purpose with a grenade-sleeve.

Originally, this throwing method required the use of special propulsive cartridges, without a bullet. This brought about difficulties at the level of the quartermaster general's department, a lack of operational efficiency when going over from the normal rifle shooting to the throw of a grenade and a serious danger for the user in case of error as regards the selection of the ammunition or the condition of the weapon at the time of the throw of a grenade.

To palliate these drawbacks, there has been proposed a comparatively high number of bullet traps, located in the aforesaid tubular shank and allowing to throw a grenade by means of a normal ball cartridge, the same as is used for shooting with a rifle.

These bullet traps are generally of a delicate and expensive construction, because they must, with a maximum of safety, intercept and maintain the bullet at the very time of the shoot, without any disastrous deformation or, maybe, rupture of the aforesaid shank.

So, traps have been proposed which consist of a series of screens for slowing down and stopping the bullet. There has also been proposed to use metallic bodies with carefully designed shapes and dimensions for absorbing the cinetic energy of the bullet and heat resulting from its interception without consequent deformations of the projectile shank.

Furthermore, these solutions have the drawback of a weight and bulkiness which are not unimportant.

For this reason, grenades have been proposed having an axial through passage allowing the bullet to go through the projectile and escape outside of same. Practical applications of this type are, for instance, described in the French Pat. No. 1.599.491 and in the publication of the German application No. 25 54 049.

This tempting conception has the disadvantage of resulting in a loss of efficiency due to the fact that also the propulsive gases can escape from the aforesaid bore, unless—as in the case of the application No. 25 54 049—a complicated obturating mechanism for obturating the bore immediately after the passage of the bullet is provided for. From the economic point of view, it is probable that a suchlike obturating device is not less expensive than a bullet trap. Furthermore, as this obturator comes into action only after a mechanical effect has been exerted by the bullet when passing, a grenade that is so equipped cannot be shot with propulsive cartridges without a bullet, unless one admits a very low efficiency, respectively an important modification of the shooting conditions.

The object of the present invention is to palliate these disadvantages by providing for the problems described hereinabove a solution which is particularly simple, inexpensive and efficient.

For this purpose, a rifle-grenade according to the invention, of the axial bore type, is characterized in that in this bore there is a "bullet-pass-through" device, made from a material with a hardness ranging from approximately 30 Shore A to approximately 70 Shore D.

A suchlike bullet-pass-through device has the characteristic that the bullet passes easily through the device and that this device closes behind the bullet, whilst practically preventing the propulsive gases from passing.

For the sake of clearness, the invention is described more in detail hereinafter, reference being made to the attached schematic drawings, in which.

Figure 1:
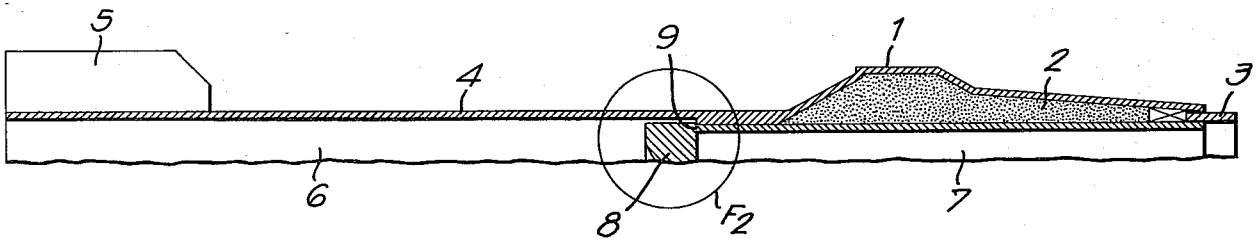
FIG. 1 shows an axial section of a rifle-grenade according to the invention.

The grenade illustrated in FIG. 1 comprises a head 1 containing an explosive charge 2, equipped with any appropriate means for firing, for instance a tubular fuse 3.

In its rear part, the head 1 is prolonged by a tubular shank 4 with vanes 5. The bore 6 of the shank 4 is apt to receive the end of a rifle barrel, which end usually consists of a grenade-sleeve for throwing.

The bore 6 is prolonged by a bore 7, which passes axially through the head 1, this bore having a diameter which is slightly greater than the calibre of the rifle used for throwing.

In principle, all the above arrangements are known.

According to the invention a bullet-pass-through device 8, made from a supple, respectively elastic, material, is located in the bore 6, preferably against the shoulder 9 provided for the purpose, for instance at the junction between the bores 6 and 7.

Numerous materials, both natural and synthetic, may be appropriate to make the bullet-pass-through device 8, provided that their hardness ranges from approximately 30 Shore A to approximately 70 Shore D. Thus, both natural and synthetic rubbers have given good results.

Figure 2:
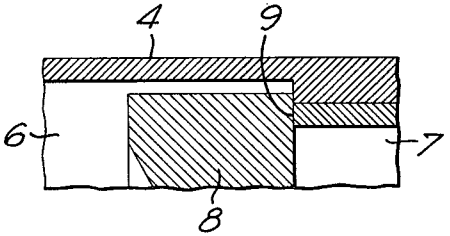
FIG. 2 shows on a larger scale a view of the part indicated by F2 in FIG. 1.

Tests have proved that the passage of the bullet through a suchlike bullet-pass-through device did practically not result in any disappearance of material, either through scoring or fusion, respectively combustion, this provided the aforesaid bullet-pass-through device is shaped in such a way that it may dilate sufficiently during the passage of the bullet. Furthermore, it is to be desired that this dilatation does not result in any appreciable deformation of the wall delimiting the bore in which the bullet-pass-through device is located. Thus, in the example of FIG. 2, the bullet-pass-through device 8 has a cylindrical shape, its diameter being smaller than the bore 6. In the present case this bullet-pass-through device is glued to the shoulder 9.

Figure 3:
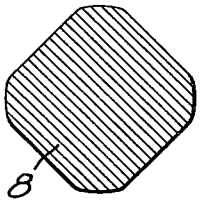

Instead of being cylindrical, the bullet-pass-through device could have a square section with rounded-off corners, the diagonal of which may be equal to or slightly greater than the diameter of the aforesaid bore 6 (FIG. 3).

Figure 4:
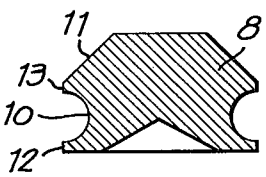
FIGS. 3 and 4 show two other shapes of the bullet-pass-through device according to the invention, that is to say a cross-section and an axial section respectively.

In the example of FIG. 4, the body of the bullet-pass-through device 8 has a cylindrical part, provided with a broad groove 10, and ends with a part in the shape of a truncated cone, so as to obtain two supporting zones 12 and 13 having the same diameter, which is slightly greater than the diameter of the bore 6.

The part 11 in the shape of a truncated cone offers also the advantage that it ensures even better the obturation of the passage opened by the bullet when passing through the body, due to the action of the pressure of the gases in the barrel of the throwing rifle.

It is clear that the examples described hereinabove have only a strictly illustrative character and that the invention can be applied with shapes that are distinctly different.

What I claim is:

1. Rifle-grenade, of the type comprising a head which is prolonged by a tubular shank, the aforesaid head being traversed by an axial bore running into the bore of the aforesaid tubular shank, characterized in that a bullet-pass-through device, of a single piece of material, is located in one of the aforesaid bores, this bullet-pass-through device being made from a material the hardness of which ranges from approximately 30 Shore A to approximately 70 Shore D.

2. Rifle-grenade according to claim 1, characterized in that the aforesaid bullet-pass-through device is backed by a shoulder provided for this purpose in the bore under consideration.

3. Rifle-grenade according to claim 2, characterized in that the aforesaid shoulder is located at the junction between the two aforesaid bores.

4. Rifle-grenade according to claim 2, characterized in that the diameter of the aforesaid bullet-pass-through device is of such magnitude, relative to the diameter of the aforesaid bore so as to permit radial expansion of the aforesaid bullet-pass-through device.

* * * * *